United States Patent [19]

Dola et al.

[11] 4,181,384

[45] Jan. 1, 1980

[54] FLAT CABLE CONNECTOR HAVING WIRE DEPLOYMENT MEANS

[75] Inventors: Frank P. Dola, Port Richey; Frederick W. Rossler, Jr., New Port Richey, both of Fla.

[73] Assignee: AMP Incorporated, Harrisburg, Pa.

[21] Appl. No.: 875,642

[22] Filed: Feb. 6, 1978

[51] Int. Cl.[2] ..... H01R 3/06

[52] U.S. Cl. ..... 339/14 R; 29/628; 339/22 B; 339/107

[58] Field of Search ..... 339/14 R, 17 F, 22 B, 339/99 R, 107; 29/628

[56] References Cited

U.S. PATENT DOCUMENTS

| | | | |
|---|---|---|---|
| 3,768,067 | 10/1973 | Rault | 339/99 R |
| 3,936,933 | 2/1976 | Folk et al. | 29/628 |
| 4,076,365 | 2/1978 | Ross et al. | 339/107 |
| 4,094,566 | 6/1978 | Dola et al. | 339/14 R |

*Primary Examiner*—Roy Lake
*Assistant Examiner*—DeWalden W. Jones
*Attorney, Agent, or Firm*—Anthony S. Volpe

[57] ABSTRACT

A multi contact electrical connector for interconnection of a ground-signal multi-conductor flat cable to a plurality of electric circuit elements such as terminal posts extending from a panel is disclosed. The connector includes a plurality of discrete terminals in a multi-contact insulating housing with a ground bus mounted on the housing. Conductor template surfaces are located on oppositely facing insulating cover members. The free ends of the conductors in the flat cable are reoriented during assembly of the connector so that proper ground and signal electrical terminations can be established using slotted plate terminal members located on centerlines differing from that employed in the cable itself.

18 Claims, 17 Drawing Figures

FLAT CABLE CONNECTOR HAVING WIRE DEPLOYMENT MEANS

BACKGROUND OF THE INVENTION

1. Field of the Invention

This invention relates to connectors used to interconnect a plurality of wires and a corresponding plurality of circuit elements such as upstanding terminal posts or the conductive paths on a printed circuit board. This invention also relates to connectors for use with a plurality of prearranged conductors or electrical paths to be variously joined or chosen to provide multi-conductive paths. This connector disclosed herein relates especially to connectors for use in interconnecting a multi-conductor flat cable having a specified ground-signal configuration with additional electric circuit elements having a generally different conductive pattern. This connector is also related to devices in which a single or common means causes either a single penetrating means to engage two or more conductors or plural penetrating means to simultaneously engage plural conductors. This invention is also related to devices in which the insulating body of the connector is split or separable at the approximate point of entry of the cable in a plane generally parallel to the axis of the cable, the sections of the insulating body exerting a clamping action on the cable.

2. Description of the Prior Art

The advent of new transmission cables in which a large plurality of wires are encapsulated in a common insulating web has resulted in significant wire handling advantages in the telecommunications and computer industries. These cables are generally manufactured with conductors located on centerlines which are defined by such considerations as the signal propogation speeds required for certain applications. Since these centerline spacings do not generally coincide with the standard centerline spacings for circuit elements used in telecommunications and computer equipment, interconnection problems have been aggravated.

An electrical connector for deploying a plurality of conductors contained in a multi-conductor cable having a flexible dielectric sheath is disclosed and claimed in U.S. application Ser. No. 743,897, filed Nov. 22, 1976 now U.S. Pat. No. 4,076,365. The connector disclosed therein is used in such a manner that the terminaion of a plurality of conductors on one centerline to conductive elements on another centerline can be easily accomplished. U.S. patent application Ser. No. 770,127, filed Feb. 18, 1977, now U.S. Pat. No. 4,094,566, discloses and claims a related connector and assembly method for use in terminating a plurality of ground-signal conductors in a flat cable to a plurality of circuit elements such as contact posts. The posts are arranged in a grid and generally have a ground-signal distribution of the conductors in the flat cable. Each of the connectors shown in these two patent applications represents an improved method for interconnecting flat cables and upstanding posts such as posts mounted on the back-plane of a computer or telecommunications equipment. The standard prior art device used for this interconnection is generally referred to as a paddleboard connector. Paddleboard connectors generally comprise a circuit board with a connector housing mounted adjacent one end. The housing contains a plurality of contact terminals for engaging the posts. A plurality of traces extend from an opposite edge of the circuit board and contact is established with the terminals in the housing. In order to terminate a flat cable to this paddleboard connector the conductors in the flat cable are generally soldered to the conductive traces adjacent this opposite edge of the printed circuit board. This soldering operation involves soldering each individual wire on the cable centerline spacing.

SUMMARY OF THE INVENTION

This invention relates to an electrical connector and a method for interconnecting a first multi-conductor electrical cable, having at least one ground-conductor between adjacent signal conductors, to corresponding circuit elements arranged in a linear array. For example, the connector can be used with a linear array of upstanding contact terminal posts. This invention employs a wire retaining member in which a plurality of conductors can be positioned for insertion into terminals located on the proper centerline spacing for eventual interconnection with the terminal posts. The wire retaining member has a series of grooves extending along an inner face. At one end of the wire retaining member the groove spacing corresponds to the cable conductor spacing. The grooves being located on the post spacing elsewhere on the wire retaining member. Each groove has a width slightly less than the diameter of an individual conductor to retain the conductor in an interference fit. A pair of upstanding ridges or barriers serve to define each groove. Each separate groove and its defining ridges are thus independent of any other groove. The interference fit of the wires in the grooves does not deform or warp the wire retaining member. In the preferred embodiment this wire retaining member serves as a multi-conductor deploying template in which the conductors can be progressively pressed into the grooves.

This connector can also be used to terminate two flat cables. The ground conductor in each flat cable can be commoned by using a laterally extending ground bus having a plurality of upstanding conductor termination members.

The objects of this invention include the provision of an electrical connector for use in interconnecting a large number of conductors to terminal posts mounted in a grid pattern on boards for use in the computer or the telecommunications industries. Square posts having a width of 0.025 in. (0.064 cm.) are commonly used. A spacing between adjacent posts of 0.125 in. (0.318 cm.) is common in the telecommunications industry. Even smaller centerline spacings are common in the computer industry and in other applications. It is, therefore, an object of this invention to terminate the conductors in a flat cable to terminal posts located on standard centerline spacings. Flat cables utilizes for such interconnection generally employ a common dielectric sheath. Quite often this dielectric sheath is composed of polyvinyl chloride. Typically, these cables have a centerline spacing between adjacent conductors which is on the order of 0.03 in. (0.076 cm.). Single cables typically have about 30 conductors. It is, therefore, an object of this invention to provide a connector which will facilitate the interconnection of cables with conductors located on a first centerline spacing, to contact posts located on a second centerline spacing which is typically greater than the first centerline spacing.

In general, the electrical transmission properties specified flat cables of the type used herein, require a ground-signal distribution in the cable which differs from the ground-signal distribution used in standard panel-mounted terminal post grids. For example, it may be necessary to terminate a flat cable having a ground-signal-ground configuration to a two row array of terminal posts having a plurality of adjacent signal posts flanked by ground posts. In general, each of the ground conductors in the cable must be commoned to each of the ground terminal posts. It is, therefore, an object of this invention to provide a connector which can establish the required electrical connections and the required reorientation of ground and signal conductive paths.

In general, it is necessary to mount similar electrical connectors in end-to-end and row-to-row configuration. It is, therefore, an object of this invention to provide a connector having a minimum length and width. For example, a connector utilized to terminate wires to two rows of contact posts located on a 0.125 in. (0.318 cm.) centerline can have a width no larger than 0.250 in. (0.635 cm.). It is, therefore, an object of this invention to provide a connector which utilizes the least possible volume.

One additional object of this invention is to provide a connector which can terminate the conductors in a flat cable on a centerline spacing generally greater than the spacing of adjacent conductors in the cable. By accomplishing this object, the termination of individual conductors is simpler than soldering conductors on the same centerline spacing as is now done with standard paddle-board connectors.

Finally, it is an object of this invention to provide a connector which can be fabricated and assembled with the wires being terminated in a minimum amount of time.

BRIEF DESCRIPTION OF THE DRAWINGS

FIG. 3 is a section view of the assembled connector.

FIG. 3A is a section similar to FIG. 3 showing the position of a signal conductor.

FIG. 6 is a side view of the hinged cover member showing the hinged strain relief section.

DETAILED DESCRIPTION OF THE INVENTION

The connector disclosed herein can be utilized to terminate two multi-conductor flat cables to the upstanding terminal posts in two rows on a panel member. One specific wiring pattern utilizing this connector is shown in schematic form in FIG. 15. A first cable having conductors arranged in a ground-signal-ground-signal-ground configuration must be terminated to two rows of terminal posts. Each row of terminal posts contains eight signal posts flanked on the end by a ground post. This specific cable contains conductors each spaced apart by approximately 0.03 in. (0.076 cm.). The cross-section of each terminal post is generally square and measures 0.025 in. (0.064 cm.) on each side. Adjacent terminal posts are on a 0.125 in. (0.318 cm.) centerline spacing. The overall dimensions of a connector in accordance with this invention would measure 0.245 in. (0.622 cm.) wide by 1.240 in. (3.150 cm.) in length. Each connector would have a heighth of 1.350 in. (3.429 cm.). This connector would occupy a volume of 0.410 cubic inches (6.178 cm.). A plurality of conductors in a flat cable could be terminated to terminal posts utilizing a connector having this volume. In addition, a connector in accordance with this invention, could be used to terminate the ground conductors of a second flat cable containing a plurality of conductors to the ground conductors in the first cable. By utilizing a similar approach it would also be possible to tap appropriate signal conductors in the second cable to appropriate signal circuits in the first cable and in the terminal post grid pattern.

Figure 1:
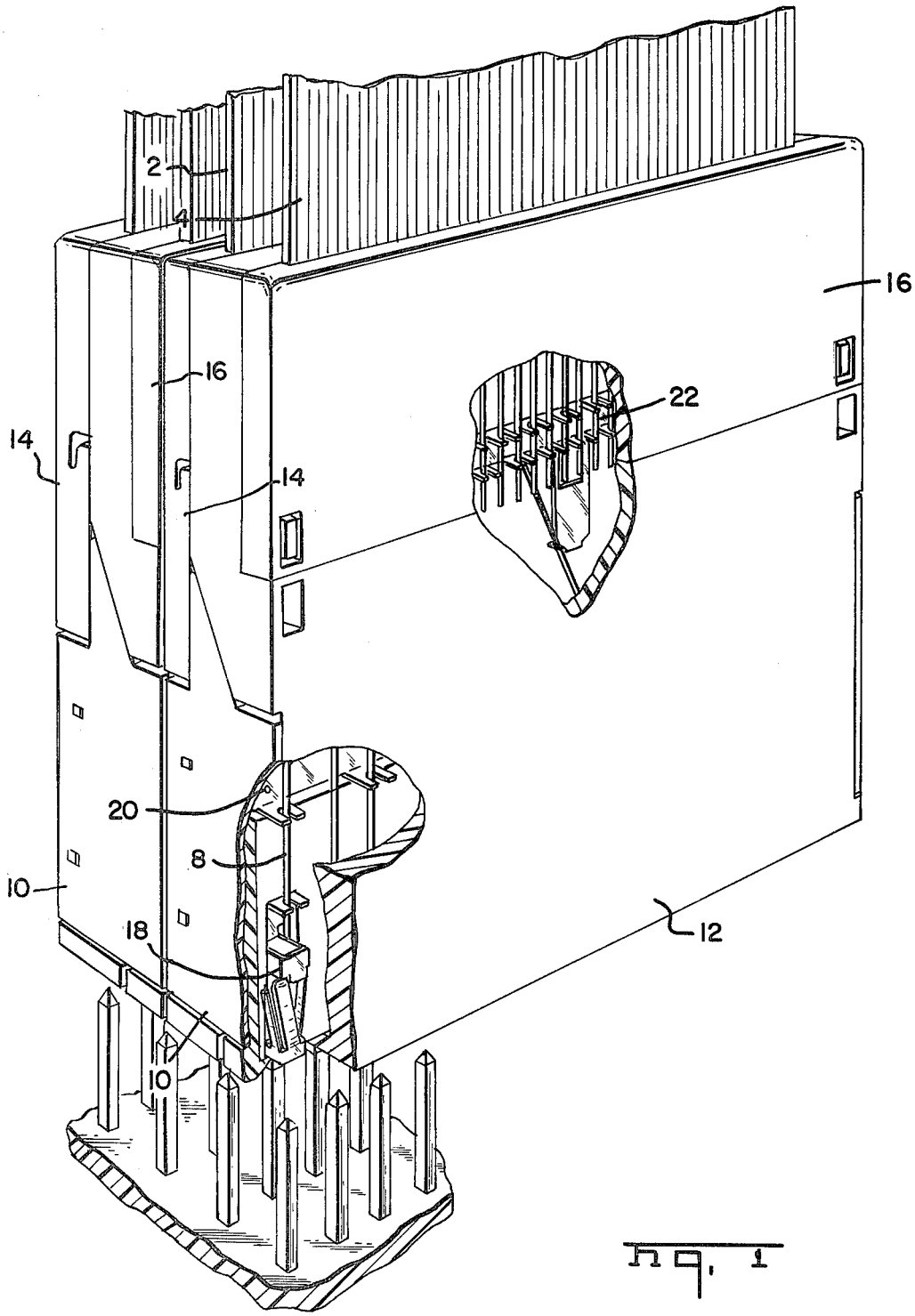
FIG. 1 is a fragmentary perspective view showing two assembled connectors for use with flat cables with the connectors positioned for mounting on an array of terminal posts.

FIG. 1 shows two side-by-side connectors in accordance with the preferred embodiment of this invention. These connectors are intended for both side-by-side and end-to-end mounting in an array of terminal posts. First multi-conductor cable 2 and auxilliary grounding cable 4 are shown extending into the rear of one assembled connector. Each assembled connector consists of a central main body member 10 flanked on opposite sides by a rigid template cover 12 and a hinged template cover 14, each of which can be molded utilizing a suitable thermoplastic. An auxilliary ground cable cover member 16 is shown mounted on the exterior face of rigid cover member 12. A plurality of contact terminals 18, one of which is shown in the fragmentary view of FIG. 1 are located along the mating face of the connector. A main grounding strip 20 is shown extending along the main body member 10 at a point intermediate the ends thereof. A single ground conductor 8 is shown extending through one wire receiving member on ground strip 20 into the wire receiving portion of the single contact 18 located adjacent one end of the connector. An auxilliary ground bus used with the auxilliary grounding cable 4 is also shown. The auxilliary bus 22 is similar to the main grounding bus 20. Both grounding bus 20, bus 22 and signal terminals 18 are fabricated from a material having spring like properties. Beryllium copper is one such material.

Figure 2:
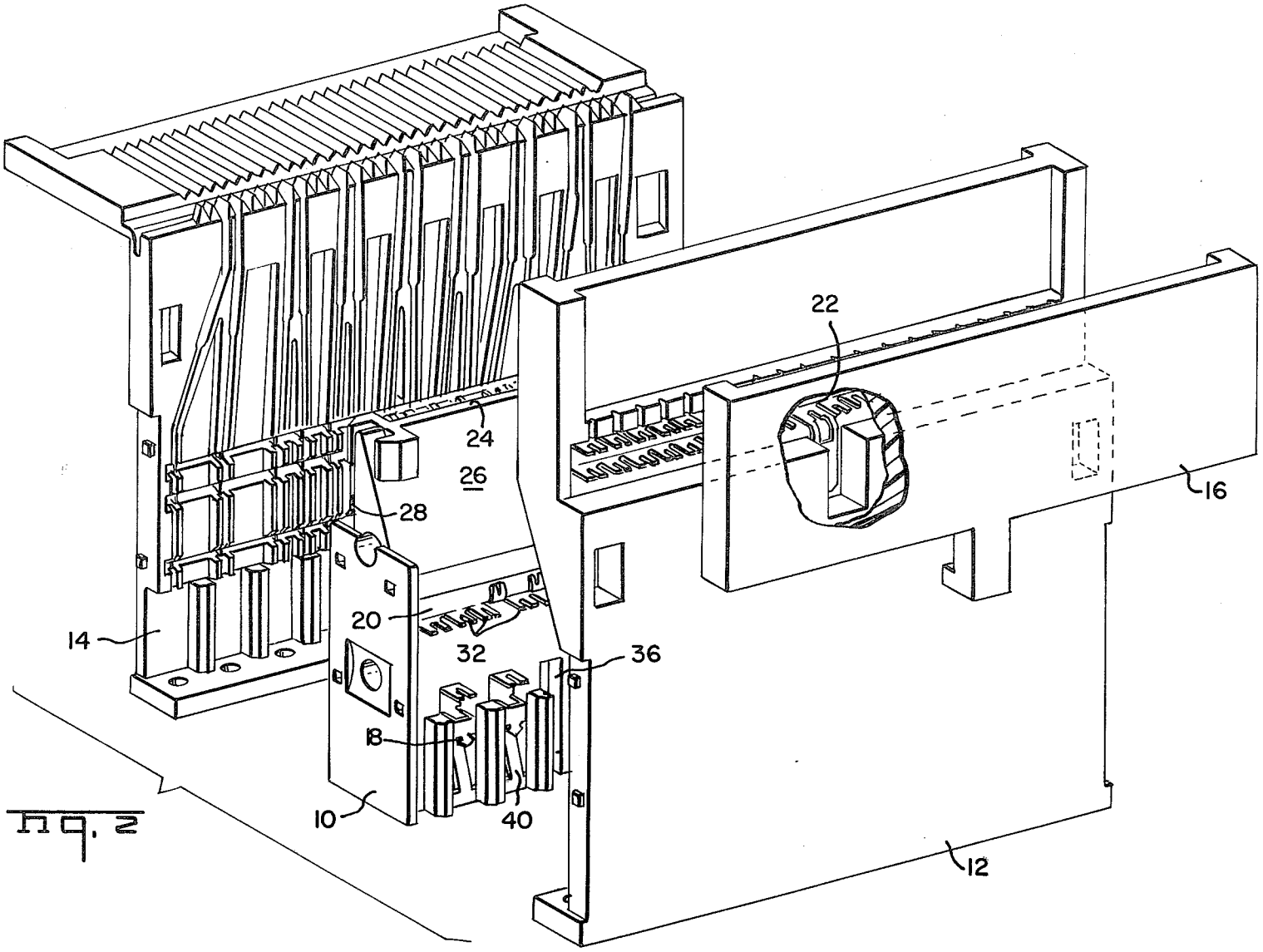
FIG. 2 is an exploded perspective view showing the relative orientation of the component parts of the connector housing.
Figures 12, 12A:
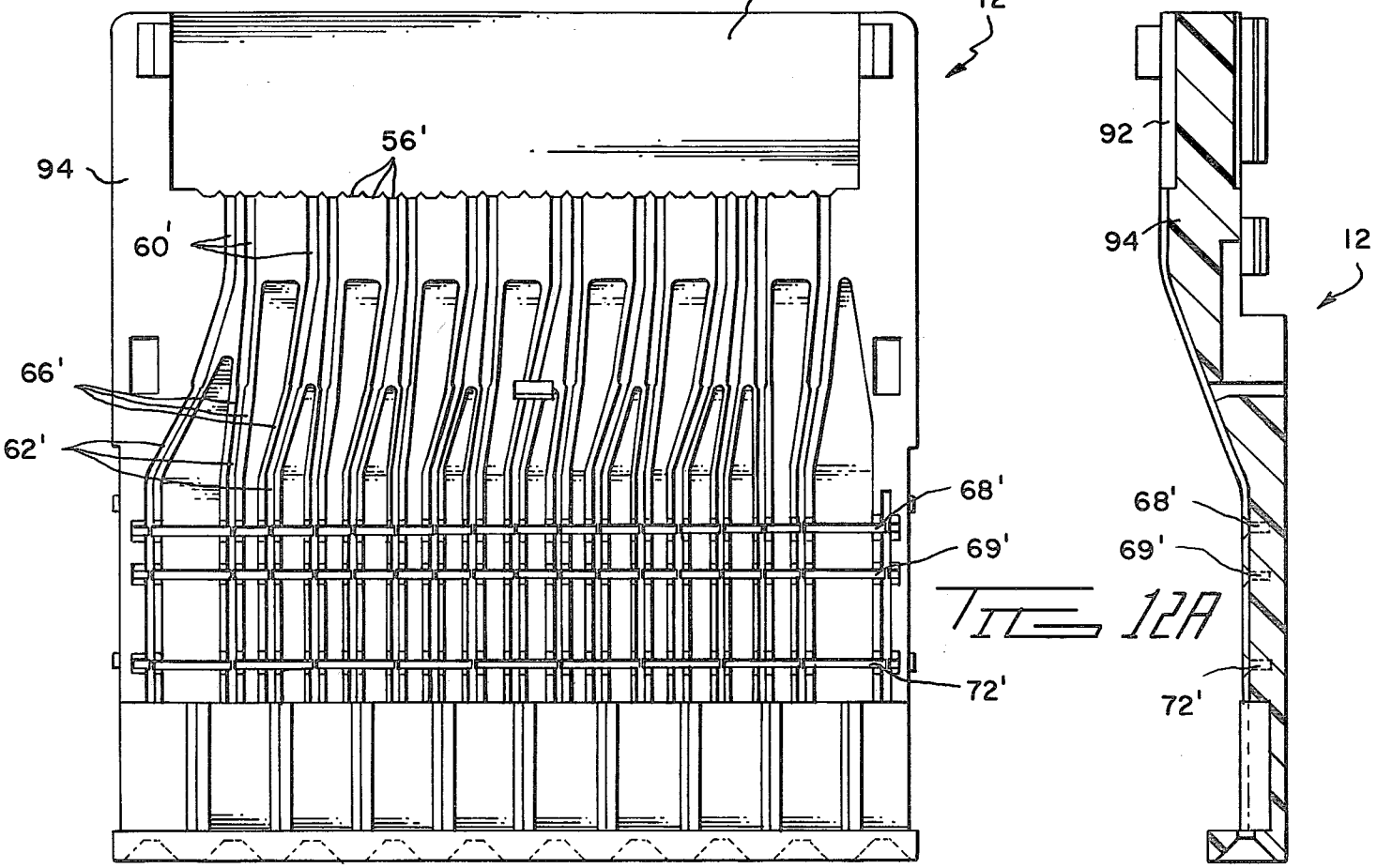
FIG. 12 is a view of the rigid cover member and the template pattern thereon.
FIG. 12A is a side view of the housing member shown in FIG. 12.

FIG. 2 is an exploded perspective view showing the relative orientation of the four housing components of a connector constructed in accordance with this invention. Appropriate contact terminals and grounding strips are also shown in FIG. 2. The inner template face of hinged cover member 14 is partially revealed in FIG. 2. Note the plurality of grooves extending along the inner face of template 14. The construction of these grooves will be more specifically described in connection with the deployment of the plurality of conductors in a single template member. Contact terminals 18 are located in cavities adjacent to mating face on both laterally facing sides of main housing member 10. It can be seen in FIG. 2 that these contact terminals are in alignment with template grooves and hinged contact member 14 as well as in the rigid cover member 12. Template grooves in cover 12 are not shown in FIG. 2. This template face is shown in FIG. 12.

FIG. 3 is a sectional view of the assembled connector member shown in FIG. 1. The positioning of the individual conductors in each of cables 2 and 4 is apparent from this view. Note that cables extend on opposite sides of main body member 10 as shown. In FIG. 3A taken along a section parallel to FIG. 3 note the nonfunctional position of the contact portion of the main grounding strip 20 which corresponds to the location of a signal conductor. Contact between signal conductors and main grounding strip 20 must be avoided. By merely deflecting the contact portion at the appropriate station on main ground bus 20 as shown in FIG. 3A, contact between the signal conductor and the ground bus is avoided. The functional and nonfunctional positions of the grounding strip shown in FIG. 3 and FIG. 4 can be programmed for a given connector configuration thus enabling the use of standard stamped ground busses. The grounding strip can also be stamped from a suitable blank with the ground bus terminals being omitted at positions which will correspond to the location of signal wires. FIG. 3 also shows position of the auxilliary ground bus 22. Bus 22 is located on the exterior of the rigid cover template 12. A ground commoning contact portion 90 is shown extending through cover member 12 from the exterior surface of the rigid cover to the inner template surface. Note that contact is made in this embodiment with a central ground conductor. This central ground conductor is then terminated to the main ground bus 20 as shown.

Figure 4:
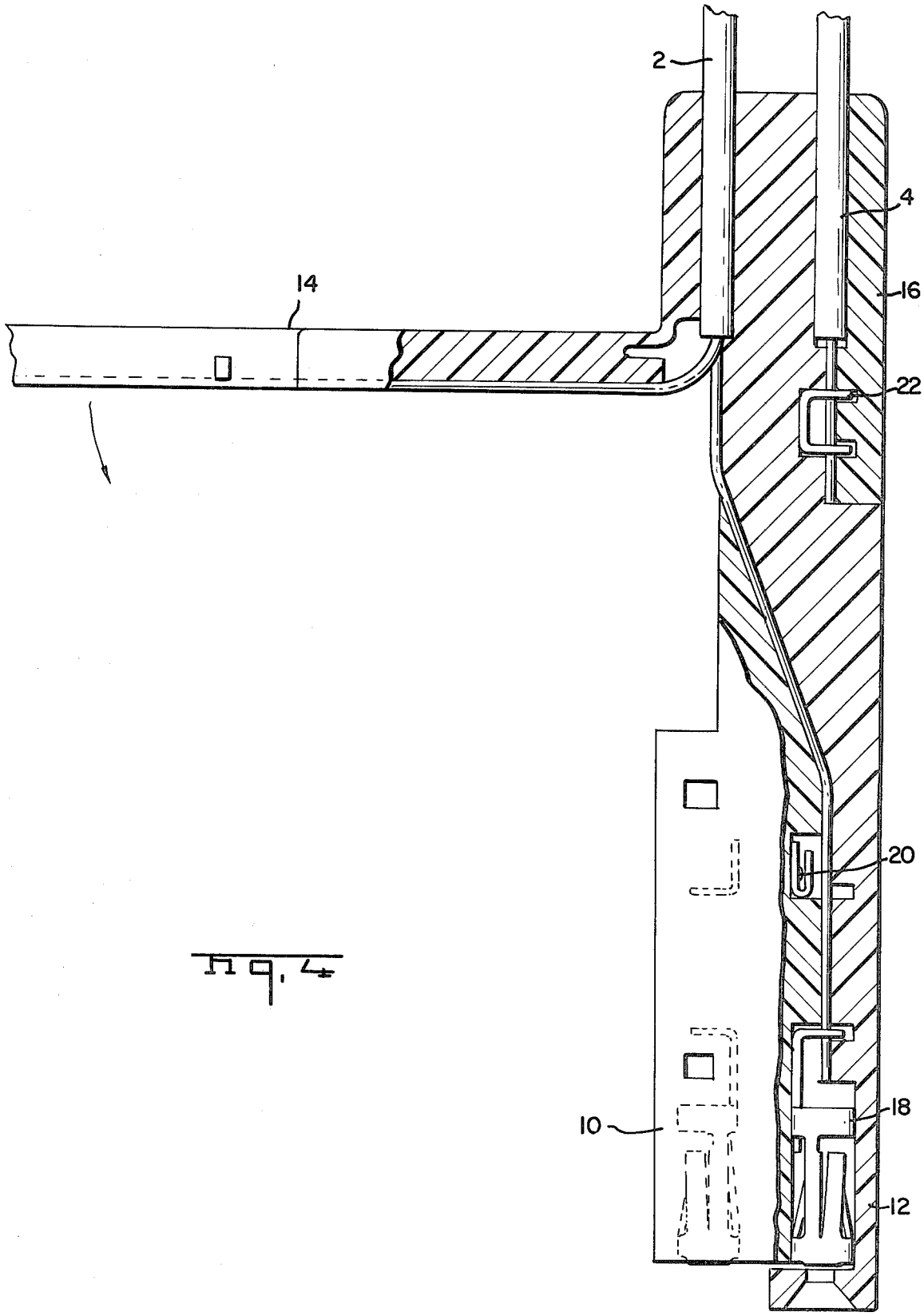
FIG. 4 is a side view of the connector with the hinged cover member in the open position.

FIG. 4 shows the hinged cover member 14 in its open position. Note that electrical contact can be established between appropriate ground or signal terminals in the main housing member and ground and signal conductors in the hinged template cover 14 by merely rotating cover 14 into mating relationship with main body member 10. As these two parts are mated, electrical termination is established by the slotted conductors.

Figure 5:
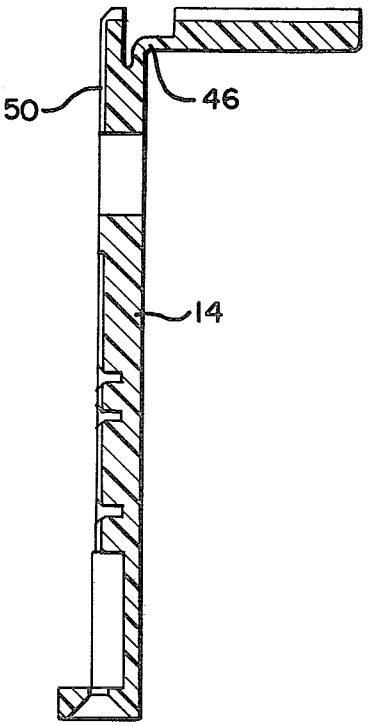
FIG. 5 is a front view showing the pattern of the grooves on the inner surface of the hinged cover member.
Figure 7:
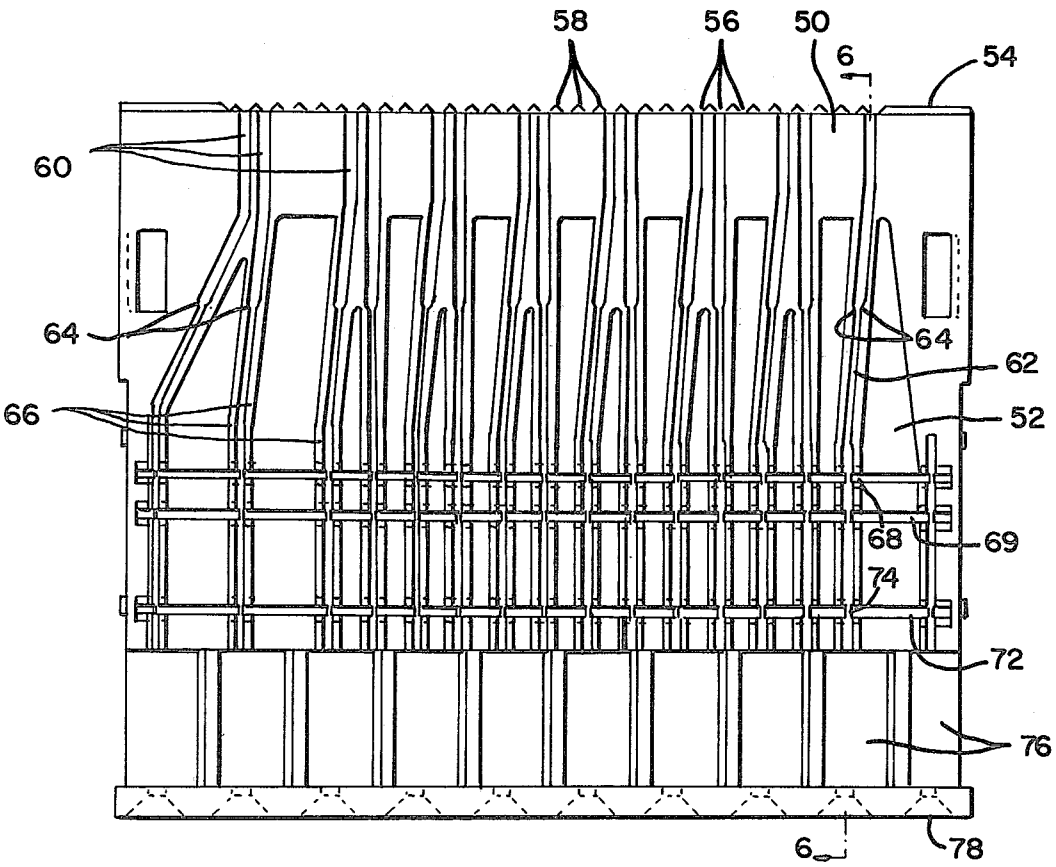
Figure 7:
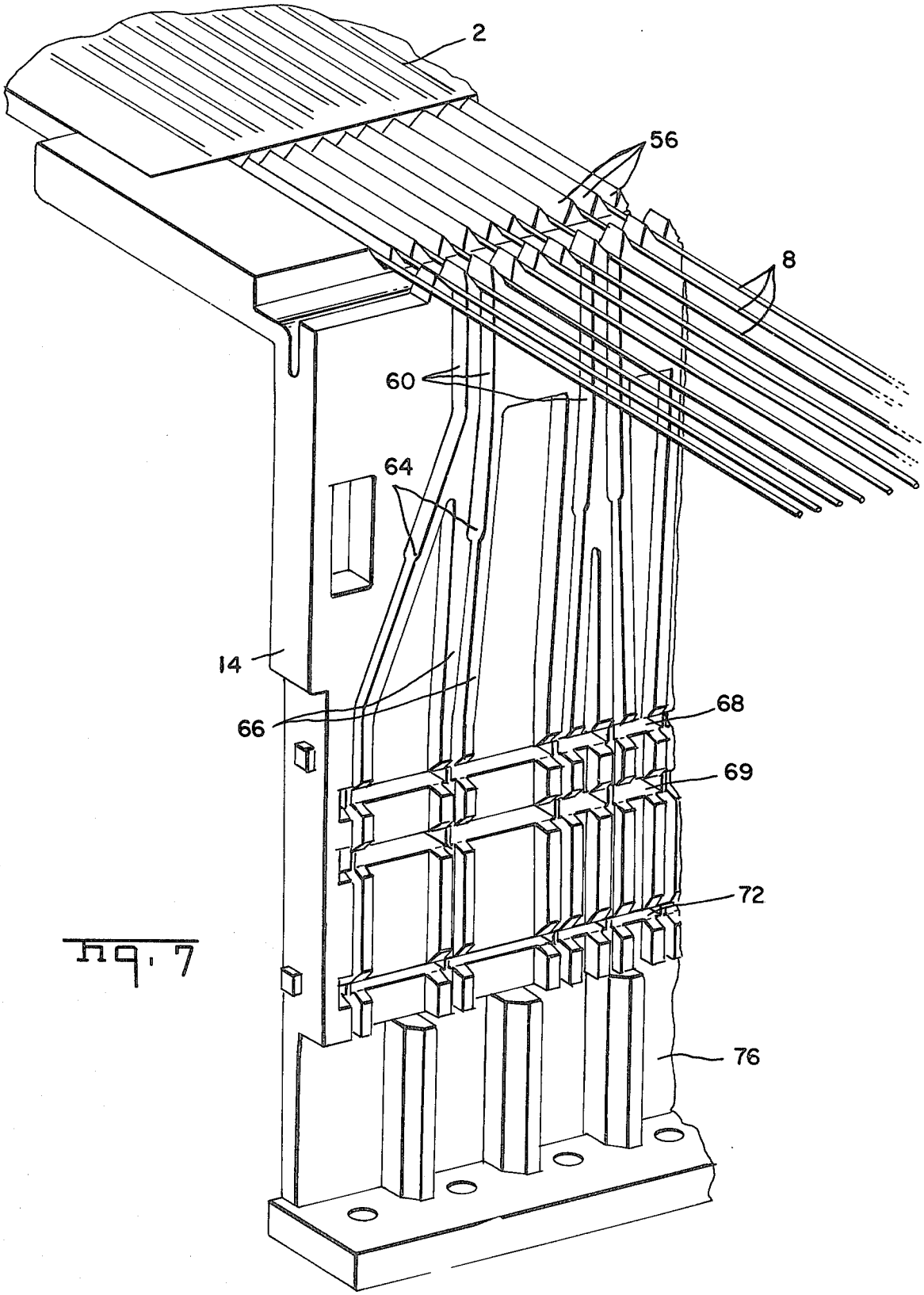

FIG. 5 is a view of the template surface of hinged cover member 14. FIG. 6 is a side view of cover 14. Template cover 14 comprises a cable strain relief member 48 and a generally flat template surface joined by an intermediate integral hinge 46. The template member comprises a generally rectangular member formed of a suitable insulating material. A thermoplastic material would be suitable for use as the hinged template cover member. The template section of hinged cover member 14 has a first laterally extending edge adjacent hinge 46. Immediately adjacent this first edge 54 is a first laterally extending surface 50 which defines the inner face of the hinged template member. A plurality of first grooves 56 extend along edge 54 perpendicular to this first lateral surface 50. A second series of grooves 60 extends from the first edge 54 along lateral surface 50. Each of the grooves 60 extend into surface 50. Each groove of the second series extends from the corresponding groove in the first series of grooves 56. Note that the first series of grooves 56 is generally perpendicular to the second series of grooves 60. This can be most clearly seen in FIGS. 2 and 7 through 10. A second lateral surface 52 parallel to and recessed from surface 50 is defined by a series of indentations between adjacent grooves. A third series of grooves 62 is defined in the region of recessed surface 52. The third series of grooves 62 are formed by pairs of elongated ridges 66. The ridges in each pair extend generally parallel. These elongated ridges generally extend from surface 52 in cantilever fashion with the base being located along recessed lateral surface 52. The end of the second series of grooves 60 and the beginning of the third series of grooves 62 is defined by incremental change in the width of each groove occurring at position 64.

Three laterally extending channels 68, 69 and 72 are located on recessed surface 52. Each of these lateral channels is generally perpendicular to each groove in the third series 62. Lateral channels 68, 69 and 72 receive the wire receiving portion of terminals located on the main ground bus 20 and on contact terminals 18. A series of small ledges 70, each located generally along the centerline of one groove, extends across each of channels 68, 69. Ledges 70 are located at only a portion of the intersections of grooves 62 and laterally extending channel 72. At those positions in which a ledge or stuffer is omitted in channel 72, no conductor will be terminated to an aligned terminal 18. In the configuration shown, ledges 70 in channel 72 are generally aligned with signal conductors. It should be noted, however, that at least one ground conductor will be terminated to a signal post and therefore at least one of the ledges in channel 72 will be used with a ground conductor.

Figure 7:
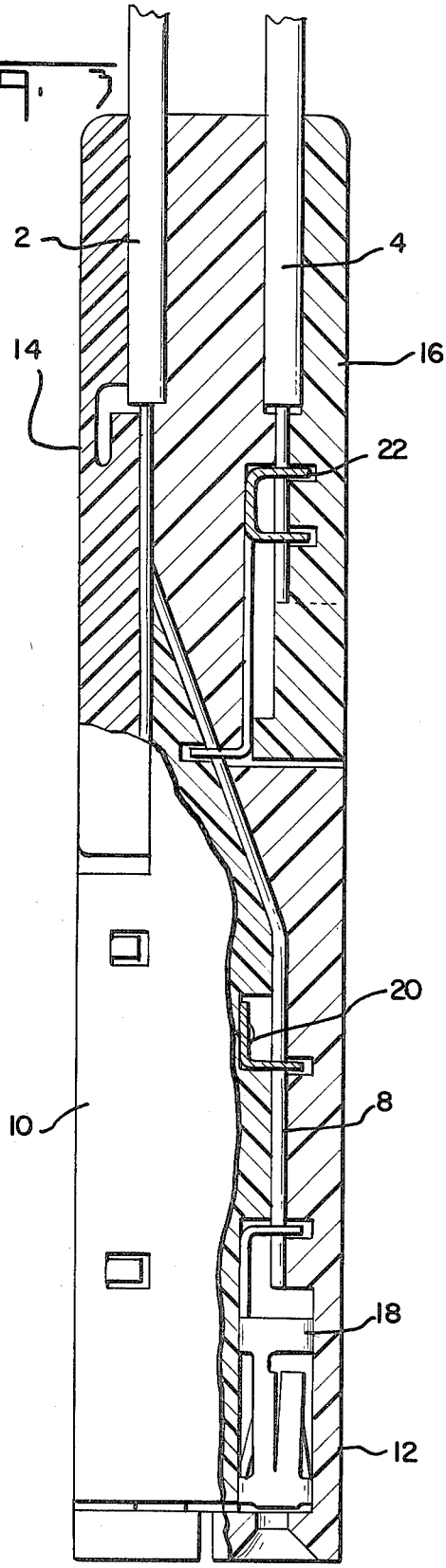
FIGS. 7 through 10 are schematic views showing the deployment of electrical conductors from the flat cable into the associated grooves in the template on the inner surface of the hinged cover member.
Figure 7A:
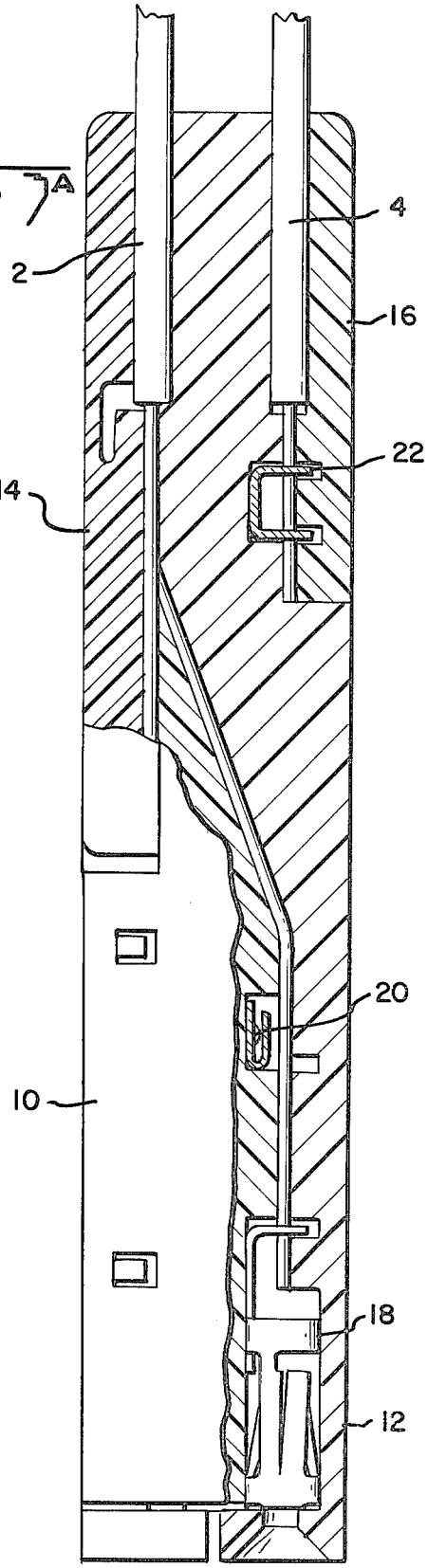

FIGS. 7 through 10 illustrate the deployment of a plurality of conductors in flat cable 2 into appropriate grooves in template cover 14. The insulation has been removed from one end of the cable. As can be seen in FIG. 7, cable 2 is first positioned with the free ends of signal and ground conductors 8 extending generally perpendicular to the first edge of template 14. The free ends of respective conductors extend through each of the first series of grooves 56. Grooves 56 thus serve to locate all of the conductors in cable 2. It can be seen that grooves 60, forming a second series, extend from only a portion of the first series of grooves 56.

Figure 8:
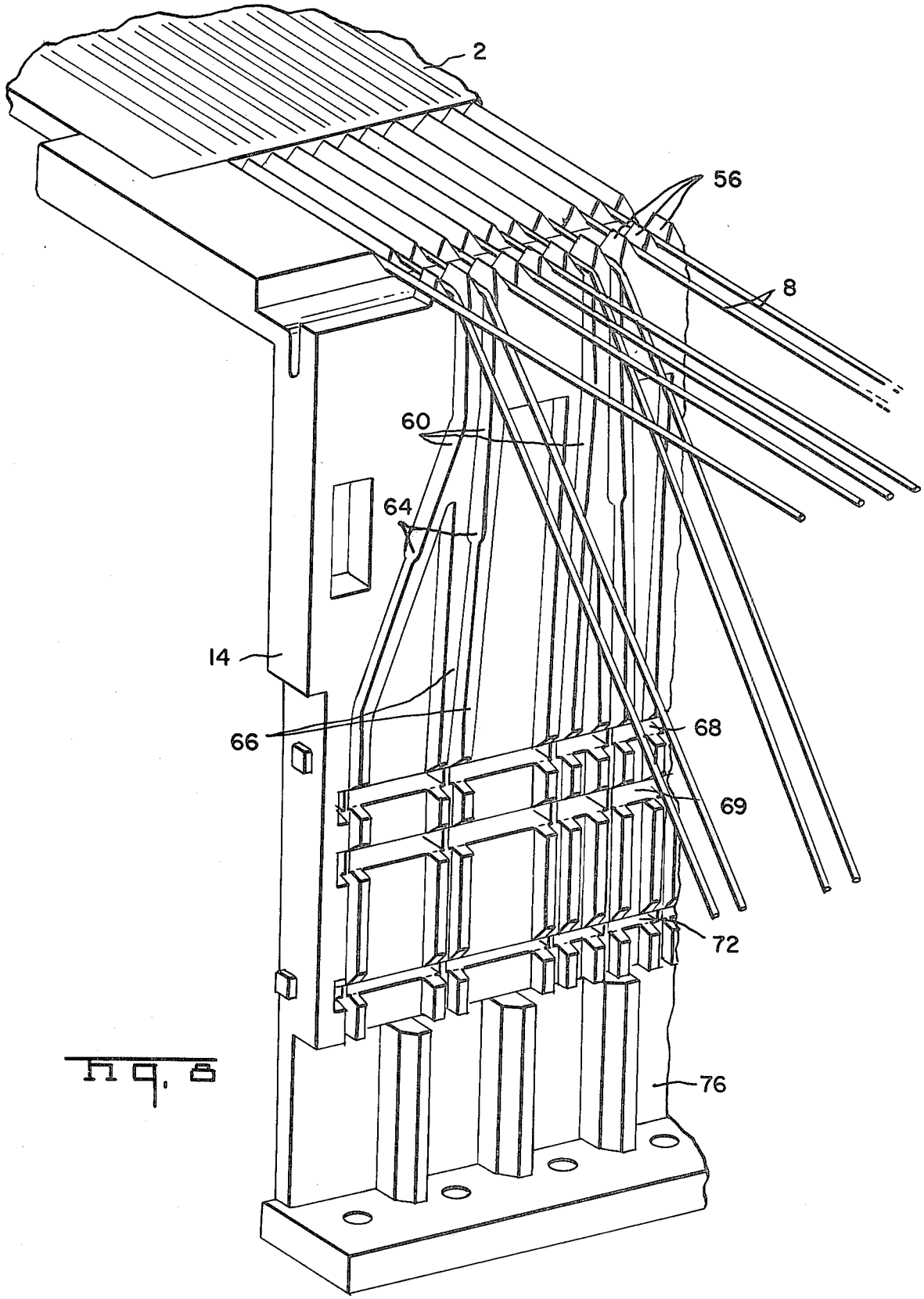

In FIG. 8 it should be noted that a portion of the conductors in flat cable 2 are bent adjacent first edge 54 relatively toward the inner surface of template member 14. In FIG. 8 it can be seen that four conductors have been bent. Each of these four conductors is in direct alignment with one of the second series of grooves 60 shown in FIG. 8.

Figure 9:
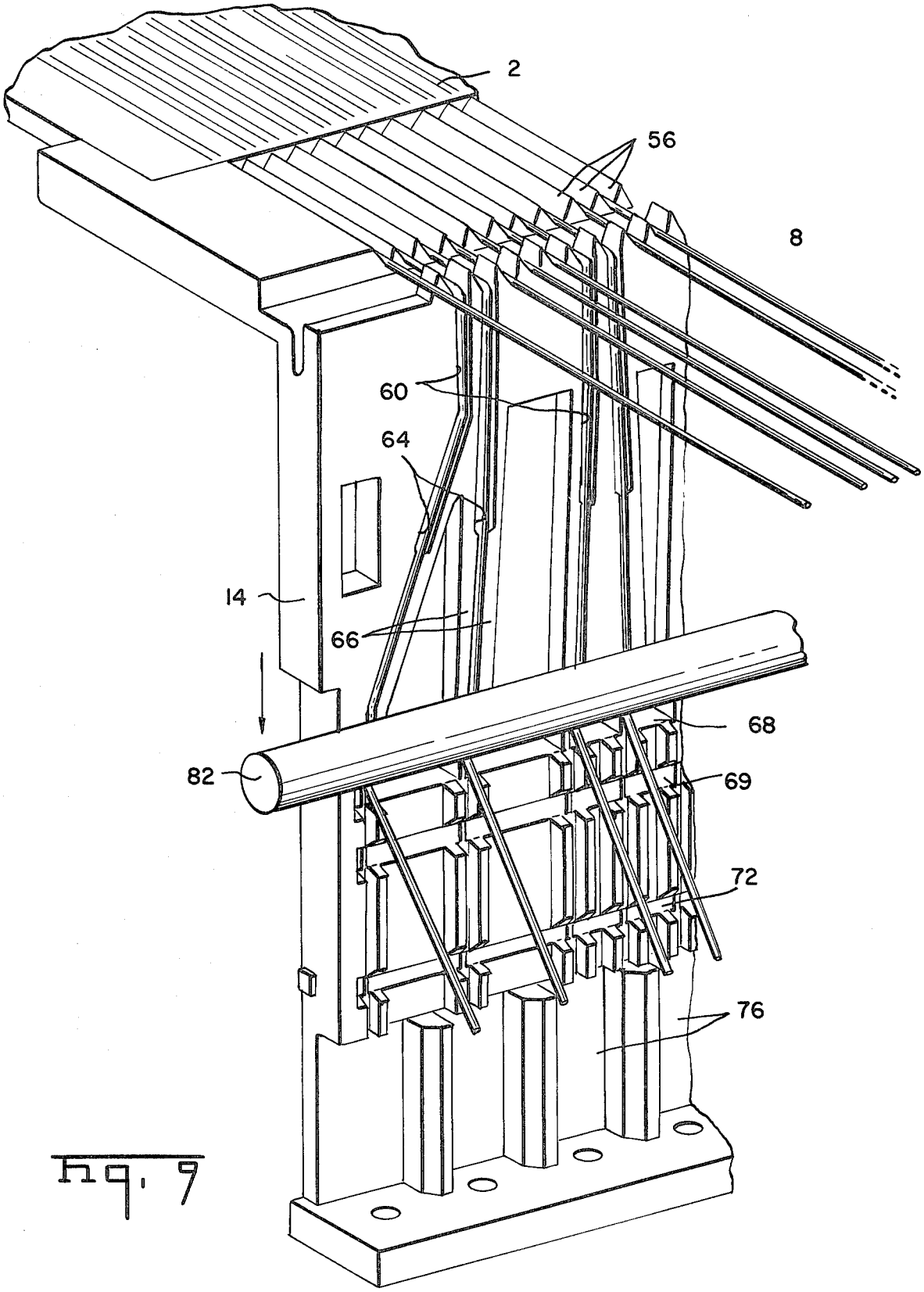

A conductor wiping member represented in FIG. 9 by a cylindrical roller 82 is then positioned against the lateral surface 50 of template member 14. Conductor wiping member 82 is moved along lateral surface 50 away from first edge 54 toward the opposite end of template member 14. The aligned conductors are thus progressively pressed into the appropriate wire receiving grooves in the first, second and third series. The first and second series of grooves have a width which is generally greater than the diameter of the appropriate conductor. The third series of grooves, however, has a width which is generally less than the diameter of one conductor. Therefore, grooves 56 and 60 serve to capture and gain control of individual conductors while the conductor is pressed into an interference fit in grooves 62 which retain the conductor in template member 14.

Figure 10:
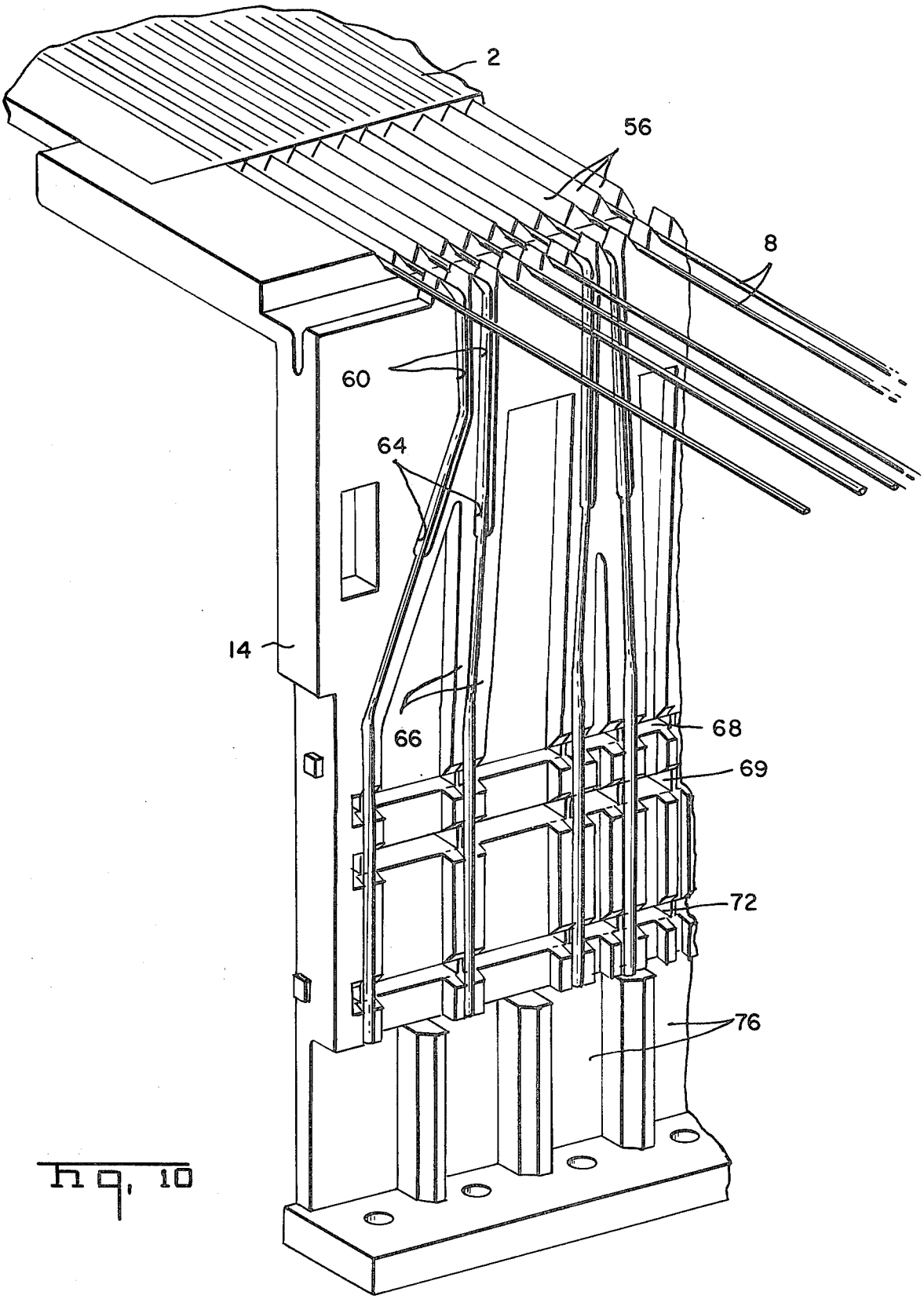

FIG. 10 shows that each of the four wires have been completely pressed into the appropriate wire deploying template grooves of the hinged template 14. Each conductor now extends across transverse channels 68, 69 and 72. Note that the centerline spacing of the conductors at the intersection of the lateral channels and the longitudinal grooves is different from the centerline spacing between corresponding conductors in cable 2. In fact, the centerline spacing of adjacent signal conductors at channel 72 is equal to the centerline spacing of adjacent signal posts. Each of the four conductors shown is retained in an interference fit in the third series of grooves 62. Since ridges 66 extend from recessed surface 52 in a cantilever fashion, the deformation of each pair of ridges by a single conductor in interference fit in one groove will not be transferred to adjacent ridges and grooves. Deformation of the template surface can not be avoided because of the interference fit of a wire in a groove. Here, each pair of ridges is independently deformed. The absence of cumulative deformation buildup assures that the template will remain dimensionally stable. If the deformation due to conductor-template interference were not isolated, the entire template could become warped as the wires are progressively pressed into appropriate grooves, and alignment between wires, grooves and contact terminals would be lost.

Figure 11:
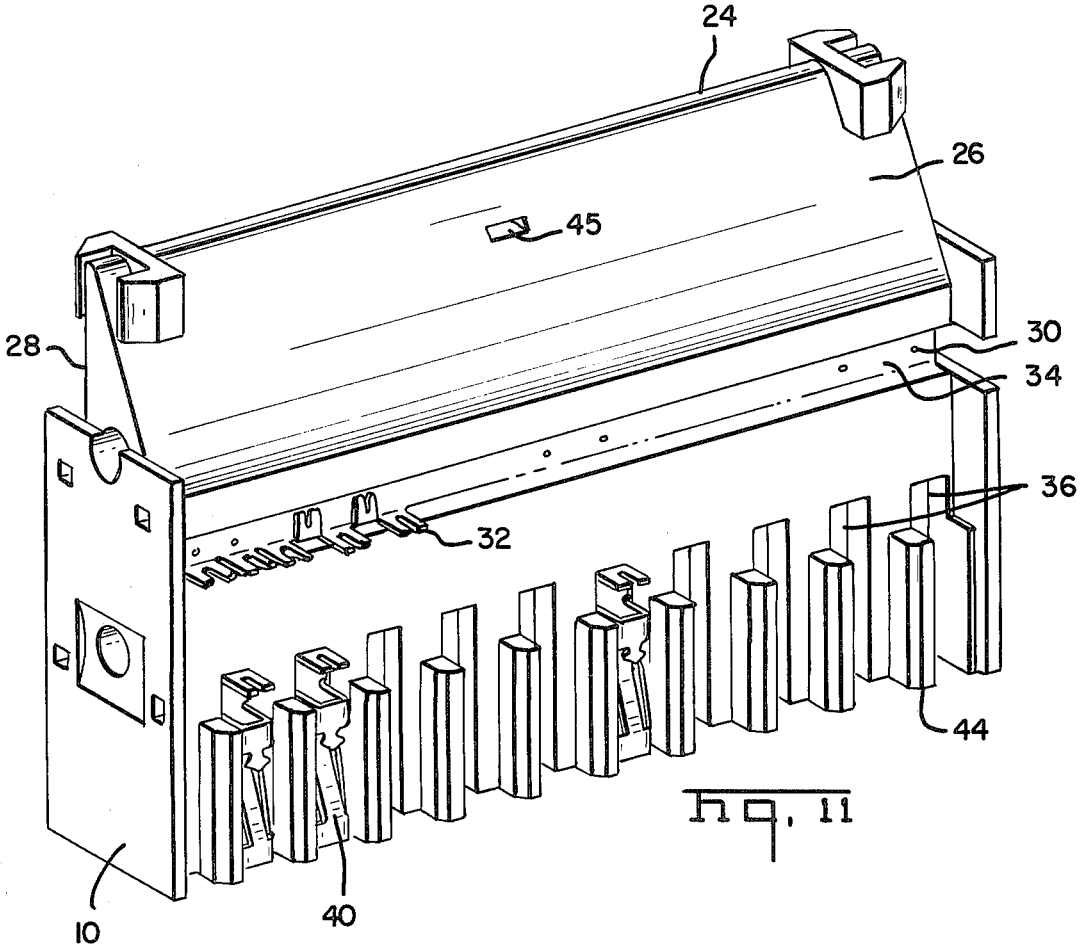
FIG. 11 is a view of the central terminal support housing.
Figure 13:
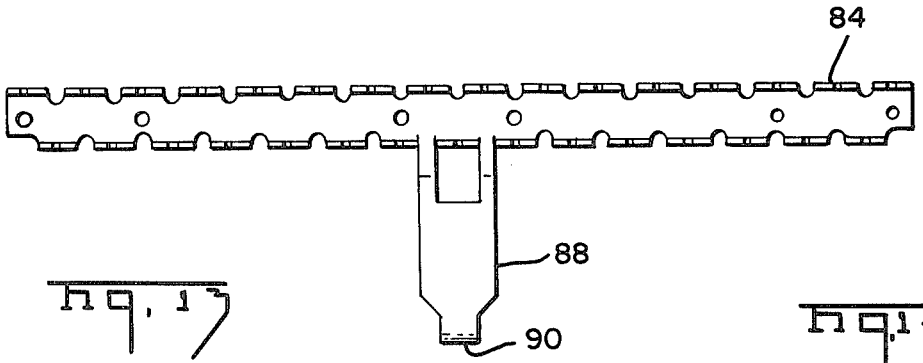
FIG. 13 is a view of the auxilliary grounding bus.
Figure 14:
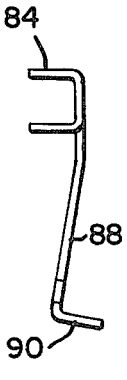
FIG. 14 is a side view of the auxilliary grounding bus showing the depending commoning terminal.

FIG. 11 is a perspective view of the terminal supporting central housing 10. Housing 10 is formed of a suitable insulating material. A synthetic thermoplastic resin suitable for molding and extrusion such as Noryl (a trademark of General Electric Company) can be used. The front view of housing member 10 shown in FIG. 11 is a representation of the side which will eventually mate with the inner surface of rigid cover member 12. As is apparent both here and in FIG. 3, the surface of housing 10, which is to mate with template 14, is generally in the same plane as the outer face of housing 10 in the vicinity of both the ground strip and the contact terminals. Face 26, however, is inclined relative to rear face 28. This inclination allows an appropriate conductor wiping member represented by roller 82 to deploy conductors into the rigid cover member 12 as well as into the hinged template 14. A central cavity 45 located adjacent upper end of housing 10 is adapted to receive a free end of depending contact terminal 90 located on the auxilliary ground bus. Intermediate the upper and lower ends of housing 10 the main ground bus 20 extends along the opposite sides and around the right end of housing 10 as seen in FIG. 11. Ground conductors on either side of central housing 10 can, therefore, be commoned. Ground wires extending across bus 20 would be terminated in the appropriate slotted plate terminal 32. It will be understood that slotted plate contact elements do not extend upwardly from the ground bus at positions corresponding to signal conductors. Contact terminals 13 also have a slotted plate termination portion extending from their upper surface generally perpendicular to the front face of housing 10. A standard post contact portion is located within cavities 36 along front face of housing 10. A longitudinally extending barrier member 44 extends along one side of each terminal 18. Together with similar barrier members in the appropriate template, barriers 44 serve to completely define terminal cavities 36 and the mating face of housing member 10.

FIGS. 12 and 12A illustrate the rigid cover member 12. FIG. 12 shows that the inner template surface of rigid cover member 14 closely resembles the inner face of hinged cover member 14. Note, of course, that the channels extending into this template face are complementary to the channels in hinged member 14. Each conductor, therefore, is deployed into either a channel in hinged member 14 or a channel in the rigid template member 12.

Rigid cover member 12 has a pattern of wire receiving and retaining channels 56', 60' and 62', ridges 66' and transverse terminal receiving recesses 68', 69' and 72' similar to the structures designated by corresponding unprimed numerals on the hinged cover member 14. Cover 14 has a cable strain relief inset 92 located adjacent the rear or cable receiving end. In general, strain relief 92 has a depth equal to one-half the thickness of first cable 2 with suitable cable securing means on the inner surface. A first series of grooves 56' are located along the lower edge of inset 92. The second series of merging grooves 60' extend along the first inner surface 94. Note that first surface 94 is initially parallel to a cable positioned within strain relief inset 92. Surface 94 subsequently is inclined away from the plane occupied for the cable. This inclination is intended to allow receipt of main body member 10 between rigid cover member 10 and hinged cover member 14. As in the hinged cover member the second series of grooves 60' merges with the narrower third series of grooves 62' formed by ridges 66' extending upwardly from recessed surface 96. In the vicinity of terminal receiving recesses 68', 69' and 72' the third series of grooves again extend parallel to the plane occupied by the cable.

As can be best seen in FIG. 2, an auxilliary cover member can be mounted on an exterior face of rigid cover member 12. This auxilliary member is for use when a second cable is to be terminated to appropriate conductors in the first cable. A laterally extending grounding strap is located on the exterior surface of housing member 12. Upstanding slotted plate wire termination portions similar to those on the main ground bus are located along auxilliary ground bus 22. A depending member 88 extends from one side of ground bus 22 with a slotted plate wire termination portion 90 located at its free end. Note that wire termination portion 90 is reversely oriented relative to the wire termination portions 84 and 86 on auxilliary ground bus 22. Wire termination portion 90 extends through a slot in cover member 12 from the exterior surface of the interior surface of cover 12 into contact with the appropriate conductor on the inner surface of the rigid template member. In the particular embodiment shown herein the depending contact member 90 is brought into contact with a ground conductor commoning not only all ground conductors in first cable 2 but all of the ground conductors in cable 4. In this manner two cables are terminated in a connector having a width no greater than twice the centerline spacing of the appropriate terminal posts.

Figure 15:
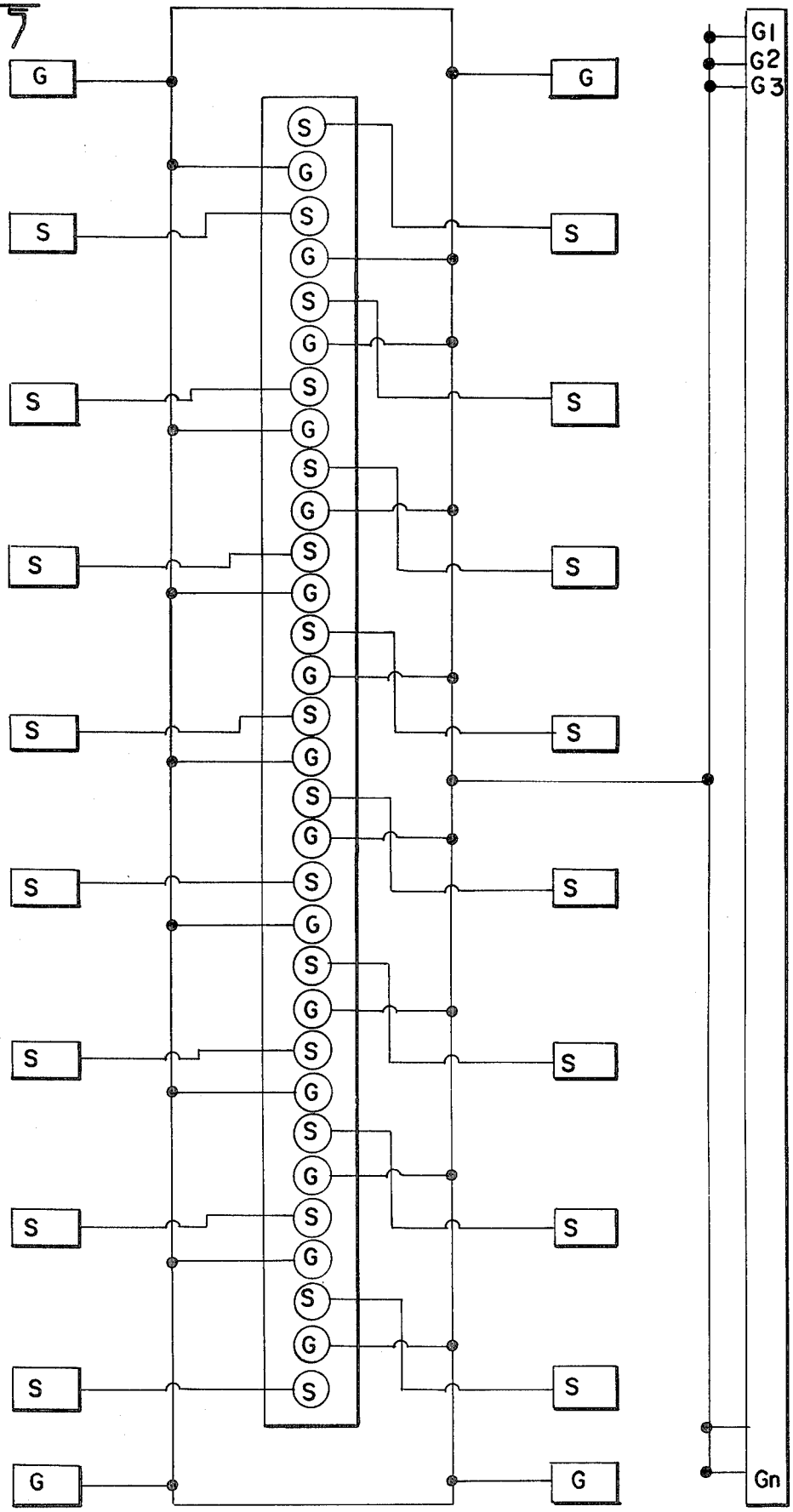
FIG. 15 is a schematic view showing a typical wiring pattern used with this connector.

FIG. 15 is a schematic representing the pattern of the conductors in cables when terminated by the preferred embodiment of the connector shown herein. Note that the first cable consists of a plurality of parallel conductors having a signal-ground-signal-ground-signal configuration. The terminal posts are represented by two rows of signal posts in a side-by-side relationship flanked by ground posts. Other similar configurations are sometimes encountered. By properly orienting the template groove means, the terminals 18 and by bending appropriate ground terminals from a functional to a nonfunctional position or shearing the terminals from the ground bus strap, many such wiring patterns can be terminated in the manner disclosed and claimed herein.

What is claimed is:

1. An electrical connector for use in interconnecting a first multi-conductor electrical cable generally having a ground-signal-ground configuration and the ground conductors in a second multi-conductor electrical cable to two rows of upstanding electrical posts, each row comprising a plurality of signal posts flanked on at least one end by a ground post, all ground conductors and ground posts being commoned; said connector comprising:

a first housing member having template means on an inner surface for receiving a portion of said conductors in said first cable, a second opposed housing member pivoted relative to said first housing member also having template means on the inner surface thereof for receiving the remaining portion of said conductors in said first cable, a third housing member having signal terminals in row configuration and a first grounding bus, both on two opposite surfaces thereof, upstanding conductor termination means on said terminals and on said first grounding bus for establishing electrical contact with conductors in said template means as said first and second housing members are mated with said third housing member, a second ground bus located adjacent to an exterior surface of said first housing member, said second grounding bus having a plurality of conductor termination means for establishing electrical contact with the ground conductors of said second multi-conductor cable, and a reversely oriented conductor termination means extending from said exterior surface to said inner surface to establish electrical contact with one of said ground wires in said first cable, whereby electrical contact can be established between corresponding terminals and conductors to form a connector which can be mounted on said plurality of posts.

2. An improved electrical connector for use in terminating a multi-conductor electrical cable to a plurality of upstanding posts positioned on a centerline spacing generally different from that of the conductors in said cable; said connector comprising: a main housing member; a plurality of contact terminals located on a lateral surface of said main housing member, post contact means on each of said contact terminals, and conductor termination means on each of said terminals, the improvement comprising:

template means for deploying selected free ended cable conductors from their centerline spacing in said cable to the centerline spacing between corresponding posts, said template means further comprising:

a template housing member having a first lateral surface extending generally perpendicular to a first edge, a plurality of first conductor groove means for engaging said selected conductors on their respective centerline spacing in said cable, second conductor groove means for progressively receiving said conductors, initially located in said first groove means and extending along said first lateral surface, generally diverging from the lateral spacing of said first groove means, a plurality of independent deformable third conductor groove means for progressively receiving said conductors from said second conductor groove means, for receiving one of said conductors in interference relationship in one groove, each groove means being formed between a pair of cantilever parallel ridges extending from a second lateral surface, said second lateral surface being parallel to and recessed from said first lateral surface, whereby said conductors are initially captured in said first groove means and then progressively pressed into said second and third groove means with contact being established between said contact terminals and said conductors as said template housing member is mated with said main housing member.

3. An improved electrical connector as set forth in claim 2 wherein said second groove means comprises a plurality of initially parallel grooves, formed inwardly from said first lateral surface, adjacent grooves diverging from parallel as said grooves recede from said first edge.

4. An improved electrical connector as set forth in claim 3 wherein said third groove means comprises a plurality of grooves having a width less than the width of said grooves which comprise second groove means.

5. An improved electrical connector as set forth in claim 4 wherein the width of the individual grooves comprising said first and second groove means is greater than the width of said conductors to be deployed and the width of said third groove means is less than the width of said conductors to be deployed so that said first and second groove means gain lateral control of said conductors in said template means.

6. An improved electrical connector as set forth in claim 2 wherein a plurality of contact terminals are located on two oppositely facing sides of said main housing member, said connector further comprising template means on the inner surface of first and second template housing member.

7. An improved electrical connector as set forth in claim 6 wherein first conductor groove means comprise a number of separate grooves equal to the number of conductors in said cable, said separate grooves being spaced apart by a distance equal to the centerline spacing of said conductors in said cable.

8. An improved electrical connector as set forth in claim 7 wherein first groove means are located on said first edge of said first template housing member in said first template housing member is initially positioned in opposite engaging relationship to the first groove means in said second template housing member to enclose each of said conductors in one of said separate grooves on the centerline spacing of the conductors in said cable.

9. An improved electrical connector as set forth in claim 8 wherein said first template housing member extends generally perpendicular to said second housing member in the initial position set forth in claim 8.

10. An improved electrical connector as set forth in claim 9 wherein said first template housing member is pivoted relative to said second template housing member.

11. An improved electrical connector as set forth in claim 8 wherein a portion of said conductors are deployed in the template means in said first template housing member, with the remaining conductors being deployed in the template means in said second template housing member.

12. An electrical connector for interconnecting a plurality of ground and signal wires on a first centerline spacing in a multi-conductor electrical cable to a plurality of corresponding circuit elements positioned on a second centerline spacing, said connector comprising:

signal wire termination means for establishing electrical contact between signal wires and corresponding circuit elements, said signal wire termination means establishing contact with signal wires upon movement of said signal wires laterally of their axes thereinto, ground wire termination means for commoning ground wires and ground circuit elements, said ground wire termination means establishing contact with ground wires upon movement of said ground wires laterally of their axes thereinto, a central insulating housing member with signal wire termination means and ground wire termination means in row configuration on two oppositely facing sides, one of said oppositely facing sides having an inclined surface adjacent said ground termination means, a rigid cover member formed of insulating material for mating with said one side having an inclined surface, having on the inner surface thereof cable engaging means and wire retaining means for holding the stripped ends of a portion of the ground and signal wires in interference fit at wire termination positions spaced from said cable engaging means, said inner surface having an intermediate inclined segment so that said wire termination positions are laterally offset from the plane occupied by said cable engaging means, and a hinged cover member having on the inner surface thereof generally similar wire retaining means for holding the remaining ground and signal wires in interference fit therein, whereby ground and signal wires can be retained in said rigid and said hinged cover member and can be terminated by mating said rigid and said hinged cover member with the respective sides of said central insulating housing member.

13. An electrical connector as set forth in claim 12 wherein said wire retaining means comprises at least in part a plurality of grooves each groove being formed by a pair of parallel adjacent ridges extending from and along the inner surface of both of said cover members.

14. An electrical connector as set forth in claim 13 wherein a ground bus is located on an exterior surface of said rigid cover member for commoning the ground conductors in a second cable, said ground bus having contact means extending from the exterior surface to the interior surface of said rigid cover member to common the ground conductors in both cables.

15. A method of deploying the free ends of a plurality of conductors located on a first centerline spacing in a multi-conductor cable to a second centerline spacing, said method comprising the steps of:

positioning said cable generally perpendicular to a template with said free ends extending past a first edge of said template, moving said conductors into a first series of grooves along said first edge, said grooves in said first series being located on said first centerline spacing each groove in said first series having a width greater than the width of said conductors, bending said conductors adjacent said first edge toward a lateral surface of said template, said lateral surface extending transversely of said first edge, progressively pressing said conductors into a second series of grooves on said lateral surface extending from said first edge, said second series of grooves merging with said first series of grooves and extending transversely thereto, said grooves in said second series being located on said first centerline spacing adjacent to said first edge and on said second centerline spacing at a point spaced from said first edge.

16. A method of deploying conductors as set forth in claim 15 wherein the width of each of said grooves in said second series is less than the width of one of said conductors for at least a portion of the length of said grooves in the second series, said conductors being progressively pressed into interference fit therein.

17. A method of attaching the signal conductors in a first multi-conductor cable having at least one ground conductor between adjacent signal conductors to corresponding adjacent signal circuit elements in a linear array of circuit elements, and commoning ground conductors in said first cable and in a second cable to ground circuit elements in said linear array, said method comprising the steps of:

removing the insulation from the free ends of the conductors in said first cable, positioning said first cable between first and second template members, with said second template member extending generally perpendicular to said first template member, bending a selected portion of said conductors in said first cable relatively towards said second template member, progressively pressing said selected conductors into conductor receiving grooves on the inner surface of said second template member, similarly progressively pressing the remaining conductors in said first cable into conductor receiving grooves on the inner surface of said first template means, mating a main housing member with signal and ground terminals thereon with said first and second template means to establish contact between the conductors in said first cable with corresponding ground and signal terminals, mounting a grounding strap on an exterior surface of said first template member with at least one terminal on said grounding strap extending through said first template member to contact a ground conductor in said first cable, and terminating the ground conductors in said second cable on said grounding strap, whereby the connector thus assembled can be mounted on said linear array of circuit elements to establish electrical continuity between corresponding circuit elements and conductors.

18. A method as set forth in claim 17 wherein said second template member is arcuately moved into mating relationship with said main housing member.

* * * * *